US010024041B2

(12) United States Patent
Doyle et al.

(10) Patent No.: US 10,024,041 B2
(45) Date of Patent: Jul. 17, 2018

(54) DEVICE FOR SUPPLYING A PRODUCT IN A TOILET BOWL

(71) Applicant: Zobele Espana, S.A., Barcelona (ES)

(72) Inventors: Dominic Doyle, Barcelona (ES); Julio Cesar Ruiz, Barcelona (ES); Fernando Mayor Sans, Barcelona (ES); Joaquim Llorente Alonso, Barcelona (ES)

(73) Assignee: Zobele Espana, S.A. (ES)

( * ) Notice: Subject to any disclaimer, the term of this patent is extended or adjusted under 35 U.S.C. 154(b) by 0 days.

(21) Appl. No.: 15/028,325

(22) PCT Filed: Sep. 8, 2014

(86) PCT No.: PCT/ES2014/070684
§ 371 (c)(1),
(2) Date: Apr. 8, 2016

(87) PCT Pub. No.: WO2015/036636
PCT Pub. Date: Mar. 19, 2015

(65) Prior Publication Data

US 2017/0089053 A1 Mar. 30, 2017

(30) Foreign Application Priority Data

Sep. 10, 2013 (EP) ..... 13382351

(51) Int. Cl.
*E03D 9/02* (2006.01)
*E03D 9/03* (2006.01)
*E03D 9/00* (2006.01)

(52) U.S. Cl.
CPC ..... *E03D 9/032* (2013.01); *E03D 9/005* (2013.01)

(58) Field of Classification Search
CPC ..... E03D 9/005
USPC ..... 4/222–224
See application file for complete search history.

(56) References Cited

U.S. PATENT DOCUMENTS

| | | | |
|---|---|---|---|
| 2007/0240252 | A1 | 10/2007 | Leonard et al. |
| 2010/0205731 | A1 | 8/2010 | Muhlhausen et al. |
| 2011/0302705 | A1 | 12/2011 | Frey |

FOREIGN PATENT DOCUMENTS

| | | | |
|---|---|---|---|
| CH | 675140 | A5 | 8/1990 |
| DE | 10 2004 047 174 | A1 | 4/2006 |
| EP | 1522319 | A1 | 4/2005 |
| WO | 0127398 | A1 | 4/2001 |
| WO | 2005070474 | A1 | 8/2005 |
| WO | 2010097151 | A1 | 9/2010 |

OTHER PUBLICATIONS

Extended European Search Report, dated Apr. 4, 2017.

*Primary Examiner* — Lori Baker
(74) *Attorney, Agent, or Firm* — Hayes Soloway PC

(57) ABSTRACT

The device for supplying a product inside a toilet bowl, comprising a fastening element for the coupling thereof to a toilet bowl, and a changeable reservoir of said product, which may be placed on the outside of the toilet bowl, and is characterized in that it further comprises an absorbent element connected to said changeable reservoir and impregnated with said product, it being possible to place said absorbent element inside the toilet bowl.
The invention enables all of the components thereof, especially those most likely to be handled, to always be as clean as possible, supplying the product in a very cost-effective manner.

9 Claims, 2 Drawing Sheets

DEVICE FOR SUPPLYING A PRODUCT IN A TOILET BOWL

The present invention relates to a device for supplying a product inside a toilet bowl, for example for supplying a liquid disinfectant every time the toilet is flushed.

BACKGROUND OF THE INVENTION

The use of devices in toilets that supply a product, for example a disinfectant, inside the toilet bowl every time the toilet is flushed is common. The aim of these devices is to ensure that the toilet is always as clean as possible. Other types of substances that tend to be used with these devices are soaps, perfumes, anti-limescale, bleach, etc.

These devices are usually placed on the upper edge of the toilet bowl, in such a way that the product is inside the bowl, which comes into contact with the water when the toilet is flushed.

The main drawback of these traditional devices is that these devices, placed on the inside of the toilet bowl become dirty very quickly, in such a way that changing them is troublesome due to the accumulation of dirt, as well as the lack of hygiene during the use thereof. The most delicate portion, since it involves more thorough handling, is the containing receptacle.

In order to solve these problems, devices are known in which the product reservoir is placed on the outside of the toilet bowl, such that changing it is easy because it remains clean, but nevertheless, it complicates the product supply system inside the toilet bowl, thus increasing the cost of the device.

A device of this type is described in the document EP 2 334 876 A1, which relates to a device for releasing a preparation inside the toilet bowl, which comprises a container connected to a supplier and a preparation release element. In this case, the preparation is released via a control unit provided with a sensor and a battery, said container being located on the outside the toilet bowl.

As is clear, the presence of the battery and the sensor increases the cost of the device, which represents a serious drawback.

Therefore, it is clear that a device the enables a product to be supplied inside the toilet bowl that is as clean and cost-effective as possible, such that changing it is easy and that the components thereof inside the toilet bowl remain clean, is necessary.

DESCRIPTION OF THE INVENTION

With the supply device of the invention, the aforementioned drawbacks are solved, having other advantages that shall be described below.

The device for supplying a product inside a toilet bowl of the present invention comprises a fastening element for the coupling thereof to the toilet bowl, and a changeable reservoir of said product, which may be placed on the outside of the toilet bowl, and is characterised in that it further comprises an absorbent element connected to said changeable reservoir and impregnated with said product, it being possible to place said absorbent element inside the toilet bowl, in order to be in contact with the water flow during flushing.

Advantageously, said absorbent element is connected to the product inside the changeable reservoir via an absorbent strip.

According to a preferred embodiment, said fastening element is a profile that may be coupled to an edge of a toilet bowl, the changeable reservoir being arranged at one of the ends thereof and the absorbent element being arranged at the other end thereof.

Moreover, said absorbent strip preferably extends over said fastening element between the changeable reservoir and the absorbent element, and said fastening element comprises a support for said changeable reservoir at one of the ends thereof. It is obvious for any person skilled in the art that any relative arrangement between the absorbent strip and the fastening element may be used (for example, strip inside the fastening element, outside or next to).

Furthermore, preferably at least the majority of the length of the absorbent strip is covered by means of a material that is impermeable to said product.

With the supply device of the present invention, it made possible for all of the components thereof, and especially those most likely to be handled, to always be as clean as possible, supplying the product in a very cost-effective manner. On the one hand, the changeable reservoir is placed on the outside of the toilet bowl, such that it is never in contact with the inner walls thereof, which are the most likely to become dirty. On the other hand, the absorbent element that provides the product is cleaned with the water from the cistern tank of the toilet each time the water is flushed.

BRIEF DESCRIPTION OF THE DRAWINGS

For a better understanding of the above, drawings are included in which a practical embodiment is schematically shown only by way of non-limiting example.

DESCRIPTION OF A PREFERRED EMBODIMENT

Figure 1:
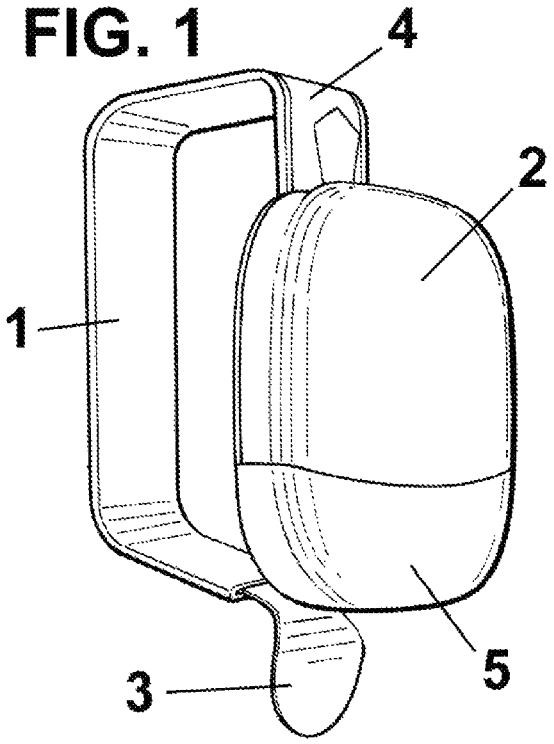
FIG. 1 is a perspective view of the supply device of the present invention.

FIG. 1 shows the supply device of the present invention in a perspective view. This device comprises a fastening element 1 for the coupling thereof to the toilet bowl, specifically to the edge of the toilet.

This fastening element 1 is preferably a profile made of a plastic material that defines a shape that is complementary to the edge of the toilet with two ends, at one of which a changeable reservoir 2 with the product to be supplied is placed, and at the other an absorbent element 3 is placed.

The changeable reservoir 2 is advantageously placed on the outside of the toilet bowl, such that it does not become dirty as a result of dirt from the inside of the toilet. In this way, it may be changed easily.

The product to be supplied, for example a liquid disinfectant or any product suitable for providing greater hygiene inside the toilet bowl, is placed inside the changeable reservoir 2.

As for the absorbent element 3, it may be made of any material than enables the absorption of said product, and is placed inside the toilet bowl. In this way, each time the water is flushed from the toilet cistern, the water pulls the product inside the toilet bowl, and at the same time, cleans said absorbent element 3, such that it is always as clean as possible.

For the continuous supply of the product from the changeable reservoir 2 to the absorbent element 3, an absorbent strip 4 has been provided that may be a single piece with said absorbent element 3, and which extends from the changeable reservoir 2 to the absorbent element 3. Preferably, and as may be seen in the figures, said absorbent strip 4 is placed on said fastening element 1.

Preferably, the majority of the length of the absorbent strip 4 is covered in an impermeable material in order to prevent the loss of active substance between the two ends of the strip, whether due to the leakage of the liquid substance or the evaporation of volatile substances.

Moreover, in order to facilitate the placement and removal of the changeable reservoir 2, one of the ends of the fastening element 1 comprises a support 5 for said changeable reservoir 2.

As has been previously stated, the changeable reservoir 2 is located on the outside the toilet bowl and the absorbent element 3 is placed inside the toilet bowl, in contact with the inner wall thereof or at a small distance in order to enable the water that comes out of said edge to enter into contact with the absorbent element 3, releasing the product and cleaning it at the same time.

Figure 2:
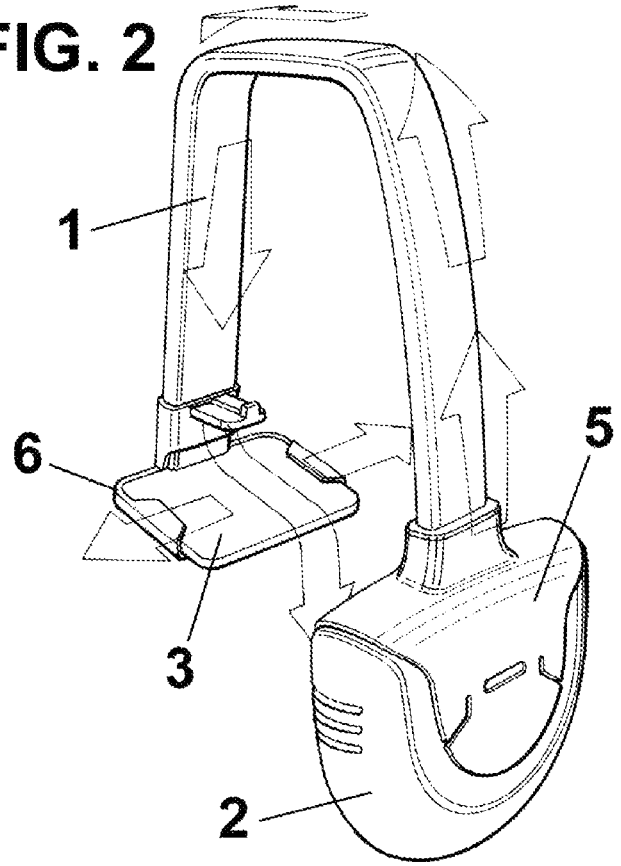
FIG. 2 is a perspective view of the supply device of the present invention with a different embodiment of the reservoir-absorbent strip connection.

FIG. 2 shows an alternative embodiment. For simplicity, the same numerical references are used in this embodiment as in the previous embodiment to identify equivalent elements.

In this case, the reservoir 2 is facing upwards, and not downwards as in the embodiment above. In this way, it may be seen that the connection between the reservoir and the absorbent strip is not part of the invention and that any know connection system between a container and a capillary element may be applied to the present invention.

In this embodiment, it may be seen that there is an impermeable support element 6 placed below the absorbent element 3. This support element 6 enables substance leakage between each release to be prevented.

Furthermore, in this embodiment, the absorbent element 3 is made from a different material to, or from the same material as, the absorbent strip 4.

It must be noted that the absorbent strip 4 may come in several shaped depending on the material used. These shapes may be cylindrical shape, flat shape or any other suitable shape. In the case of the cylindrical shape, the material used may be, for example, a cotton wick, or polyester fibres covered by a plastic covering. In the case that it is a flat shape, the material used may be, for example, a polypropylene fabric or non-woven fabric covered by a polyethylene film.

As for the absorbent element 3, it has a flat shape and may be, for example, a polypropylene fabric or non-woven fabric covered by a polyethylene film.

Despite having referenced a specific embodiment of the invention, it is clear to a person skilled in the art that the supply device described may undergo numerous variations and modifications, and that all the details mentioned may be substituted for others that are technically equivalent, without moving away from the scope of protection defined by the attached claims.

The invention claimed is:

1. A device for supplying a product inside a toilet bowl, comprising:

a fastening element for coupling to the toilet bowl, a changeable reservoir of said product, placed on the outside of the toilet bowl further comprising an absorbent element connected to said changeable reservoir and impregnated with said product, wherein said absorbent element is sized to place inside the toilet bowl; and an impermeable support element disposed below the absorbent element.

2. The device for supplying a product inside a toilet bowl according to claim 1, wherein said absorbent element is connected to the product inside the changeable reservoir by an absorbent strip.

3. The device for supplying a product inside a toilet bowl according to claim 1, wherein said fastening element has a profile shaped to couple to an edge of a toilet bowl, the changeable reservoir being arranged at one end thereof and the absorbent element being arranged at the other end thereof.

4. The device for supplying a product inside a toilet bowl according to claim 2, wherein said absorbent strip extends over said fastening element between the changeable reservoir and the absorbent element.

5. The device for supplying a product inside a toilet bowl according to claim 1, wherein said fastening element comprises a support for said changeable reservoir at one of the ends thereof.

6. The device for supplying a product inside a toilet bowl according to claim 2, wherein at least a majority of the length of the absorbent strip is covered by a material that is impermeable to said product.

7. The device for supplying a product inside a toilet bowl according to claim 3, wherein said absorbent strip extends over said fastening element between the changeable reservoir and the absorbent element.

8. The device for supplying a product inside a toilet bowl according to claim 3, wherein said fastening element comprises a support for said changeable reservoir at one of the ends thereof.

9. The device for supplying a product inside a toilet bowl according to claim 4, wherein at least a majority of the length of the absorbent strip is covered by a material that is impermeable to said product.

* * * * *